United States Patent [19]

Seidel et al.

[11] 4,331,124

[45] May 25, 1982

[54] FLUE ASPIRATED OVEN

[75] Inventors: Harry W. Seidel, Mertztown; William J. Day, Jr., Allentown, both of Pa.

[73] Assignee: Raytheon Company, Lexington, Pa.

[21] Appl. No.: 54,079

[22] Filed: Jul. 2, 1979

[51] Int. Cl.[3] ..... A21B 1/00

[52] U.S. Cl. ..... 126/21 A; 126/21 R; 126/273 A

[58] Field of Search ..... 126/21 R, 273 A, 21 A

[56] References Cited

U.S. PATENT DOCUMENTS

| | | | |
|---|---|---|---|
| 2,800,864 | 7/1957 | Ward | 126/21 A |
| 3,090,371 | 5/1963 | Davis | 126/21 A |
| 3,384,067 | 5/1968 | Rawald et al. | 126/21 R |
| 3,659,579 | 5/1972 | Henderson et al. | 126/21 A |
| 3,783,854 | 1/1974 | Hurko et al. | 126/21 R |
| 3,915,149 | 10/1975 | Kemp | 126/21 R |

*Primary Examiner*—Albert W. Davis
*Assistant Examiner*—Wesley S. Ratliff, Jr.
*Attorney, Agent, or Firm*—William R. Clark; Milton D. Bartlett; Joseph D. Pannone

[57] ABSTRACT

A gas-fueled oven which is capable of safely assuming high temperatures such as occur during pyrolytic self-clean cycles and which employs a single multi-purpose fan for directing cool air flows over wall surfaces, for providing aspiration and temperature dilution of hot flue products, and for providing combustion air for a power broiler burner.

8 Claims, 4 Drawing Figures

FLUE ASPIRATED OVEN

BACKGROUND OF THE INVENTION

This invention relates to gas-fueled ovens and has particular reference to gas-fueled ovens which are capable of assuming relatively high temperatures such as may occur, for example, during a pyrolytic self-clean operation. It is known that pyrolytic cleaning operations cause the temperature of the inner walls of the oven to reach levels of as much as 900°-1100° F. or higher.

Obviously when the inner walls of the oven reach such high temperature levels, the heat tends to radiate or be convected or conducted to outer walls, thereby raising the outer walls to undesirably high and possibly unsafe temperature levels. Attempts have been made to overcome this problem by supplying additional baffling to prevent some of the internally generated heat from contacting the outer wall structure. Other attempts to overcome or reduce the problem included the use of one or more fans to blow cool air through the spaces between the inner and outer walls.

In gas-fueled ovens, the exhaust of hot combustion gases must also be taken into consideration. Such gases, including combustion products, usually are allowed to escape through the top or back walls of the oven. This poses an especially severe problem in built-in wall ovens where the surrounding wall or cabinet structures may be damaged. This problem has been partially overcome by providing means for exhausting the combustion flue gases through the front of the oven, usually just above the oven door. Such exhaust may be facilitated by a fan or blower. However, in such cases the exhausted gases are extremely hot and, therefore, highly undesirable for obvious reasons.

Because of the proximity of the upper or broil burner to the flue outlet in a gas-fueled range, it has been difficult to entrain primary and secondary air for combustion. This thus presented additional problems when designing an efficiently operable oven.

SUMMARY OF THE INVENTION

The above and other disadvantages of known gas-fueled ovens have been overcome in the present invention by the provision of a single fan or blower which is strategically positioned so as to provide flow of cooling air to the walls of the oven structure and to components within the structure, to aspirate and to dilute the temperature of flue gases, and to supply combustion air for a power broiler burner. The forced flow of air by the blower functions additionally to actuate suitable safety means whereby in the event of failure of the blower to produce flow of cooling air the oven burners will be automatically extinguished.

In accordance with this invention the oven structure includes an inner liner or tank which defines the oven cavity. The tank is enclosed at top, sides, back and bottom by an outer shell which is spaced from the outer surfaces of the tank. Insulation is disposed within this space, as is well known. The shell is enclosed at the top, sides and back by casings which are spaced from the shell to provide compartments through which cool air may be circulated, thus efficiently cooling the outer surfaces of the top, back and sides of the shell. The temperatures of these surfaces are thus maintained at safe levels and enable the oven to be positioned within a wall and operated at pyrolytic self-clean temperatures without damage to the wall.

A fan or blower is strategically mounted atop and at the rear of the shell, and apertures are provided above the front of the top casing and at the bottom of the side casings for admittance of cool exterior air when the blower is operated, thus providing constant flow of cooling air over the exterior surfaces of the shell.

A flue is provided in the top wall of the tank and directs heated combustion products upwardly into a mixing tank located on the top of the top casing. A conduit connects the mixing tank with the blower so that the blower can direct cool air through the mixing tank and into an exhaust duct, and in so doing the cool air will mix with the hot flue products rising from the flue. The momentum of the cool air from the blower entrains the hot flue products, cooling them and drawing them off into the exterior atmosphere.

Such dilution of the temperature of the flue products is especially effective, reducing the exhaust temperature from an undiluted temperature of about 900° F. to about 300° F. Known prior attempts to accomplish this have resulted in reduction of the temperature to only about 550° F.

The blower is also connected to the broil burner so as to supply primary combustion air under predetermined low pressure directly to the burner head for mixing with the gas being delivered to the burner. Additionally, electrical switch means is provided in the blower outlet conduit for activation by the air stream from the blower. The switch means is electrically connected to the burner controls and functions to close the burner gas supply valves when absence of air flow indicates inoperation of the burner, thus providing additional safety in the operation of the oven.

BRIEF DESCRIPTION OF THE DRAWINGS

The above and other advantages of this invention will become apparent from the following description taken in connection with the accompanying drawings, wherein.

DESCRIPTION OF THE PREFERRED EMBODIMENT

Figure 1:
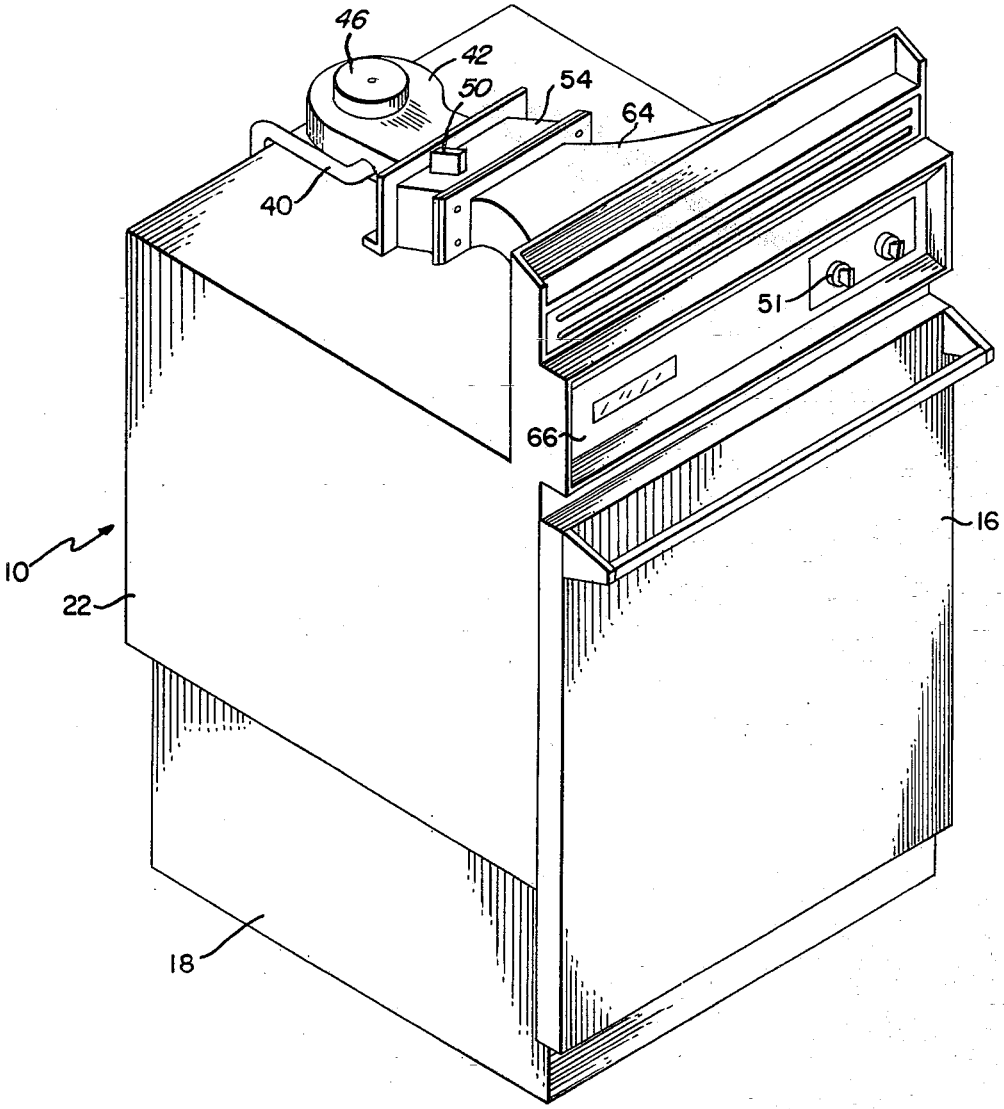
FIG. 1 is an isometric view of a wall oven embodying the invention.

Referring more particularly to the drawings wherein like characters of reference designate like parts throughout the several views, there is shown in FIG. 1 the exterior of an oven 10 of a type designed especially for mounting within an opening in a wall. In such installations the ovens are usually surrounded by flammable material such as wood and, therefore, it is necessary that the outer wall temperatures of the oven be maintained at all times at sufficiently low levels such that damage will not occur to the oven surroundings.

When the ovens are of the pyrolytic self-clean type, the interior cavity of the oven reaches a level of as much as 700°-1100° F., and in conventional ovens the heat will be transferred to the outer wall surfaces in undesirable amounts as will raise the outer wall temperatures at unsafe levels.

Figure 3:
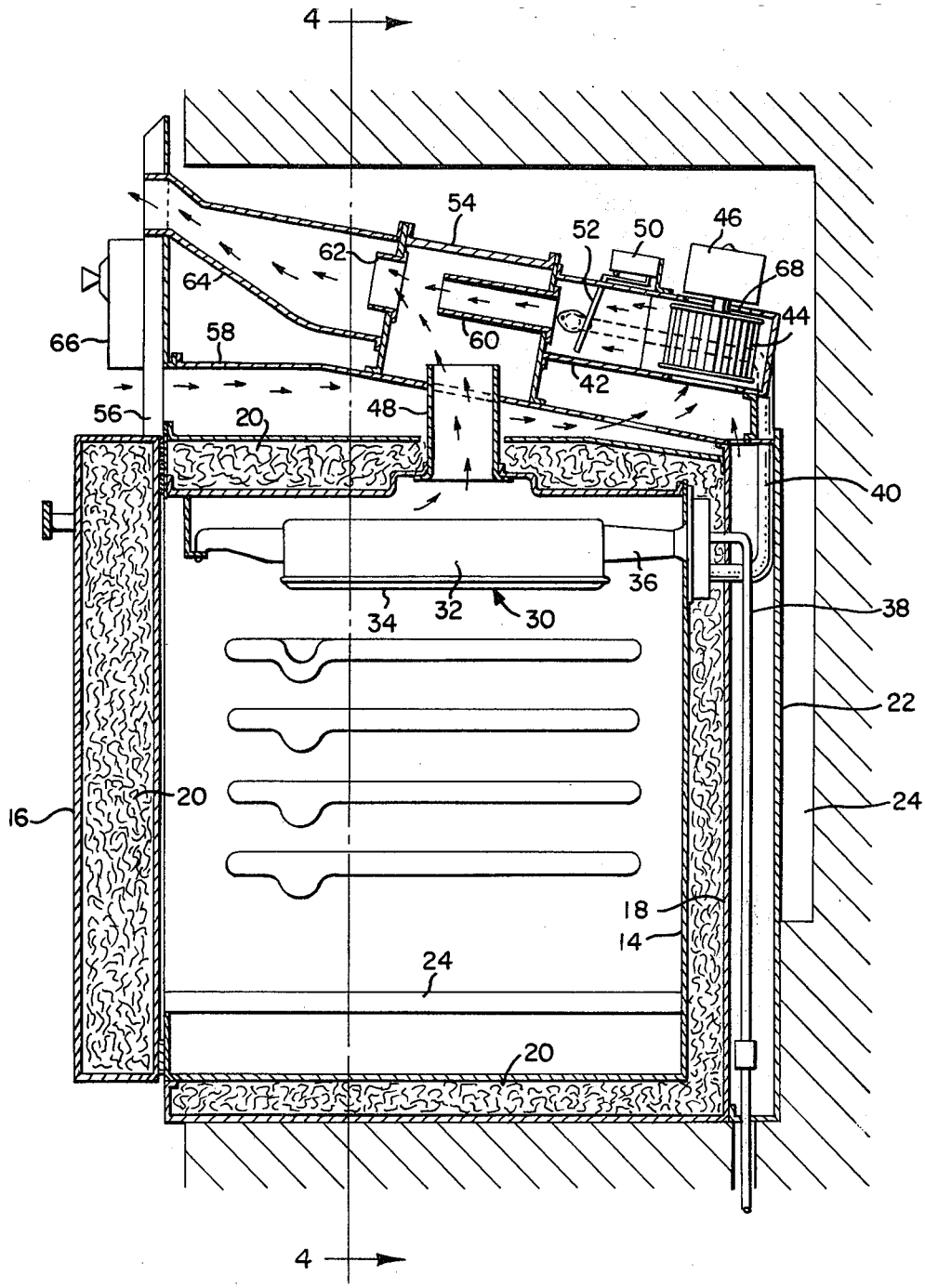
FIG. 3 is an enlarged vertical sectional view taken substantially on line 3—3 of FIG. 2 looking in the direction of the arrows.

The oven 10 comprises a central oven cavity 12 (FIG. 4) which is formed by a boxlike inner oven liner 14 having a front opening closed by a door 16 (FIG. 3). The door 16 is hingedly supported over the opening by an outer oven housing 18 which encloses the liner 14 in spaced relation with it, with the space being occupied by suitable insulation 20 in the known manner. The door 16 is similarly filled with insulation.

Figure 4:
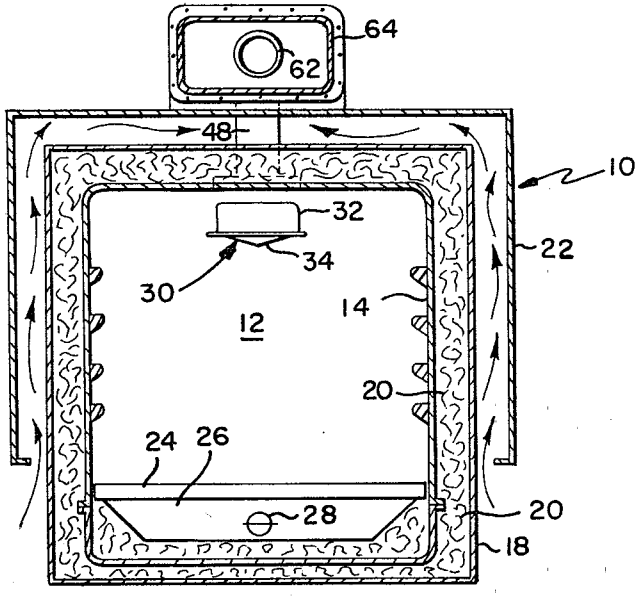
FIG. 4 is a reduced size transverse sectional view taken substantially on line 4—4 of FIG. 3 looking in the direction of the arrows.

As shown best in FIG. 4, the top, back, and portions of the sides of the housing 18 are encased within a jacket 22 through which cooling air is circulated, as will be described. The liner 14, housing 18 and jacket 22 are all fabricated of sheet metal construction, as is well known in the industry.

Figure 2:
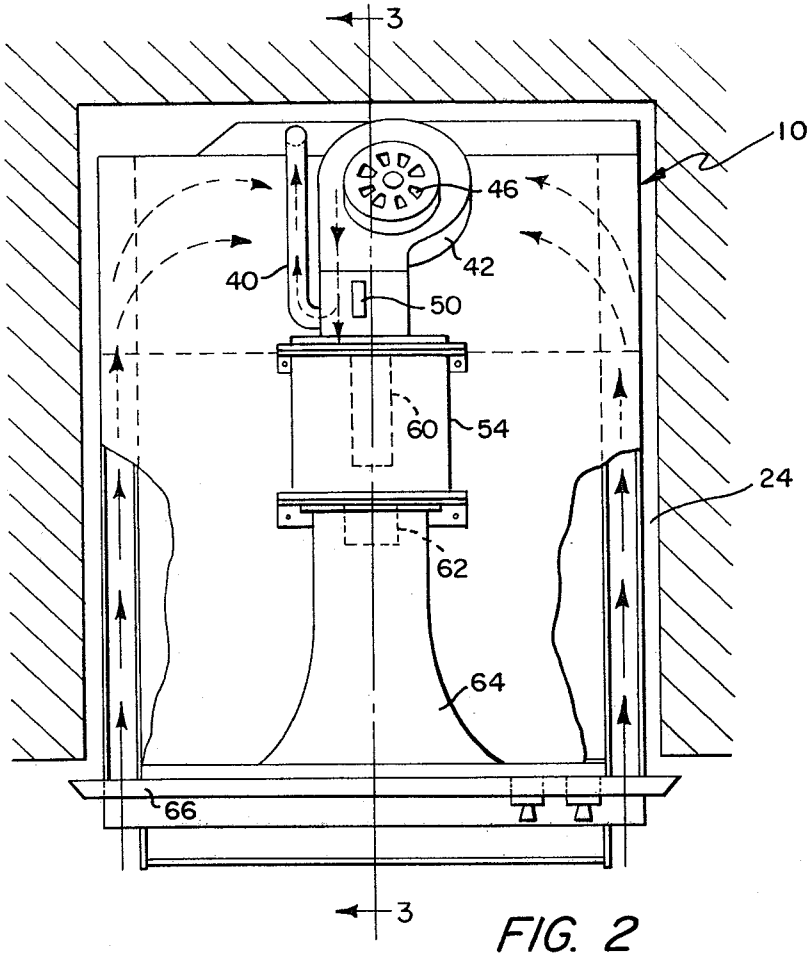
FIG. 2 is a top plan view of the oven shown in FIG. 1.

The oven assembly 10 is adapted to be positioned within an opening in a wall 22 as shown in FIGS. 2 and 3 with an air space 24 preferably being provided around a major portion of the assembly to avoid excessive direct contact of the oven walls with the surrounding walls.

A removable floor 24 is located slightly above the bottom of the oven liner 14 on a burner box 26 within which is a gas-fueled bake burner 28, preferably of the ported blue flame type. When the burner 28 is operated in the known manner, hot air in the burner box 26 will be vented upwardly into the oven cavity 12 to raise the temperature therein. Burner 28 is supplied with fuel in any conventional manner by means not shown.

In the upper region of the oven is positioned a broil burner 30 such as, for example, the radiant burner shown and described in U.S. Pat. No. 3,303,869. Such burners are well known and, therefore, details thereof are not provided herein.

Referring to FIG. 3, the burner 30 includes a hollow burner head 32 of a selected boxlike shape having an open bottom which is closed by a combustion-sustaining screen assembly 34. A venturi 36 has one end connected to the burner head 32 and is connected at its other end to a fuel supply pipe 38 which preferably extends downwardly at the rear of the oven in the space between the back wall of housing 18 and the jacket 22. The pipe 38 may be connected in any desired manner through suitable controls (not shown) to a source of gaseous fuel. Such fuel may be propane, butane, natural or manufactured gas.

Primary air is directed into the burner head 32 for mixing with the gas so that combustion will take place at the screen assembly 34. For this purpose a pipe 40 has one end connected to the venturi 36, with its other end being connected to a compartment 42 above the oven, which compartment contains a fan or blower 44 for forcing air down through pipe 40 into the venturi 36 and burner head 32. The blower 42 is operated in a conventional manner by a motor 46.

Above the broil burner 30 a flue 48 extends up through the top wall of the oven liner 14, insulation 20, and top wall of housing 18 for exhaust of flue products from the interior of the oven. The flue products are forcibly exhausted, in accordance with this invention, by the fan 44 as will be described, and since the broil burner 30 is located in relatively close proximity to the flue 48 it is difficult to entrain air for combustion without the use of the fan 44 and pipe 40. However, excess air from the cooling-venting system (to be described) is entrained into the burner with the static pressure of the system, and thus there is produced a one hundred percent primary air power burner.

An interlocking safety system is provided for assuring that the fan is on whenever the burner 30 is operated. To achieve this a normally open switch 50 is mounted on the outside of compartment 42 and is operatively connected to the fan motor 46. When the gas control knob 51 (FIG. 1) is operated to turn on the burner 30, the motor 46 will also be turned on by conventional electrical circuitry. A paddle, blade or vane 52 which is pivotally supported on the compartment extends into the air stream created by the fan 44 and has a portion located adjacent switch 50. When the motor 46 is off, the paddle 52 is immobile and the switch 50 remains open. However, when the motor 46 is turned on, the resulting air flow will move paddle 52 to close the switch 50. This in turn will open the gas valve (not shown) and allow gas to flow into the burner 30. If for any reason the motor 46 is burned out or the fan 44 for any reason ceases to operate, the lack of air flow will cause the paddle 52 to return to its initial position, opening switch 50 and deenergizing and closing the gas valve, thus shutting off the flow of gas to the burner.

Another primary function of the fan 44 is to cool the oven and thereby prevent a fire hazard condition, and also provide cooling of oven combustion products which are exhausted into the surrounding atmosphere. For these purposes there is provided a chamber 54 above the oven and into which the hot exhaust from the oven is directed from flue 48. Cool air enters above the oven through aperture 56 and flows beneath panel 58 (FIG. 3) around the outside of flue 48 and thence upwardly into fan compartment 42 where the fan 44 propels it forwardly through a cooling air outlet tube 60 which projects into chamber 54 above the end of the flue 48. The fan air is used to create a pressure drop across the cooling air outlet tube 60, which pressure drop in turn causes the flue products to be drawn upwardly from the oven cavity through the flue 48.

Thus, the flue gases are mixed with and cooled by the fan air in chamber 54 and exit through a throat 62 and a mixing chamber 64 into the surrounding atmosphere at the front of the oven above the control panel 66. With such a flue cooling system as described, the flue exhaust temperature during a clean cycle is only about 300° F., compared with a temperature of about 900° F. with undiluted flues.

In accordance with another important feature of this invention, the air passages at the back and sides of the oven between the housing 18 and jacket 22 allow air to be pulled by fan 44 over the heated surfaces of the housing 18. As seen in FIG. 4, cool air is drawn into the air passages from beneath the lower edge of the jacket or shell 22 and flows upwardly and over the top of the housing 18 and passes into fan chamber 42 through openings (FIG. 3). Heat which passes by conduction through the oven liner or tank 14, insulation 20, and housing 18 is pulled along by the air movement through the air passages, thus not allowing an overage of heat to be conducted through the jacket or shell to overheat the surrounding areas.

Cool air is also permitted to enter through the motor 46 and through apertures beneath the motor in the top of fan compartment 42. Air passing through the motor obviously helps to cool the motor. All air passing into the top of fan compartment 42, as through aperture 68, creates a cool air movement through space 24 between the jacket 22 and the surrounding walls.

It will be understood from the foregoing that the fan system is used for multi purposes, to cool the unit and its components, to aspirate and dilute the temperature of the flue gases, and supply combustion air for a power broiler burner and actuate the safety switch.

It is to be further understood that various modifications and changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. An appliance comprising the combination of an oven having walls, burner means within said oven, a flue having one end communicating with the top of said oven for exhaust of flue gases from the oven, an air chamber surrounding at least a portion of said oven and having an inlet opening at its bottom, a blower compartment mounted on top of said oven and having at least one aperture communicating with said air chamber, exhaust ducting connected with said compartment, blower means for drawing air into said compartment from said air chamber and expelling said air through said exhaust ducting, said flue having its second end terminating within said ducting whereby flue gases from within said oven will be aspirated by and mixed with said air flowing through said ducting, means for connecting said burner with said compartment for supplying combustion air from said compartment to said burner under pressure from said blower means, and detection means for detecting presence of air flow from said blower means.

2. An appliance as set forth in claim 1 wherein said detection means includes a vane pivotally disposed in the path of air flow from the blower means, and switch means operable by movement of said vane in response to presence or absence of air flow from the blower means.

3. An appliance comprising the combination of an oven having walls, a gas burner in said oven, means for supplying gaseous fuel to said burner, an air chamber surrounding at least a portion of said oven and having an inlet opening at its bottom, a blower compartment mounted on top of said oven and having at least one aperture communicating with said air chamber, blower means within said compartment for drawing air into said compartment from said air chamber, piping means connecting said burner with said compartment for supplying combustion air from said compartment to the burner under pressure from said blower means, and detection means mounted on said compartment for detecting presence of air flow from said blower means.

4. An appliance as set forth in claim 3 wherein said detection means includes a vane pivotally disposed in the path of air flow from the blower means, and switch means operable by movement of said vane in response to presence or absence of air flow from the blower means.

5. An appliance comprising the combination of an oven having walls, an air jacket enclosing at least a portion of said walls and spaced therefrom to provide air passages therebetween, burner means within the oven, a blower compartment mounted on said oven and having at least one aperture communicating with said air passages, exhaust ducting connected at one end to said compartment and terminating above the front of the oven, blower means in said compartment for drawing cool air from the air passages into said compartment and expelling it through said exhaust ducting, piping means connecting said burner means with said compartment for supplying combustion air from said compartment to said burner means under pressure from said blower means; and detection means mounted on said compartment for detecting presence of air flow from said blower means.

6. An appliance as set forth in claim 5 wherein said detection means includes a vane pivotally disposed in the path of air flow from the blower means, and switch means operable by movement of said vane in response to presence or absence of air flow from the blower means.

7. An appliance comprising the combination of an oven having walls, a burner in said oven, means for supplying gaseous fuel to said burner, a flue in the top wall of said oven, an air jacket enclosing at least a portion of said walls and spaced therefrom to provide air passages therebetween, input air ducting extending along the top wall of the oven, a blower compartment located at the rear of the oven and having apertures communicating with said air passages and said input air ducting, exhaust ducting above said input ducting and connected with said blower compartment, blower means in said compartment for drawing cool air into said compartment from said passages and simultaneously from said input ducting and expelling it through said exhaust ducting, piping means connecting said burner with said compartment for supplying combustion air from said compartment to said burner under pressure from said blower means, and said blower compartment including detection means for detecting presence of air flow from said blower means.

8. An appliance is set forth in claim 7 wherein said detection means includes a vane pivotally disposed in the path of air flow from the blower means, and switch means operable by movement of said vane in response to presence or absence of air flow from the blower means.

* * * * *